US007141127B2

(12) United States Patent
Yoshizawa

(10) Patent No.: US 7,141,127 B2
(45) Date of Patent: Nov. 28, 2006

(54) LOW CORE LOSS MAGNETIC ALLOY WITH HIGH SATURATION MAGNETIC FLUX DENSITY AND MAGNETIC PARTS MADE OF SAME

(75) Inventor: Yoshihito Yoshizawa, Fukaya (JP)

(73) Assignee: Hitachi Metals, Ltd., Tokyo (JP)

( * ) Notice: Subject to any disclaimer, the term of this patent is extended or adjusted under 35 U.S.C. 154(b) by 423 days.

(21) Appl. No.: 10/756,462

(22) Filed: Jan. 14, 2004

(65) Prior Publication Data

US 2006/0118207 A1 Jun. 8, 2006

(30) Foreign Application Priority Data

Jan. 17, 2003 (JP) ..... 2003-009291

(51) Int. Cl.
*H01F 1/147* (2006.01)

(52) U.S. Cl. ..... 148/307; 148/311; 148/313

(58) Field of Classification Search ..... 148/306, 148/307, 311, 313
See application file for complete search history.

(56) References Cited

U.S. PATENT DOCUMENTS 4,881,989 A 11/1989 Yoshizawa et al.
4,945,339 A * 7/1990 Yamauchi et al. ..... 340/551
5,151,137 A 9/1992 Yoshizawa et al.
5,619,174 A * 4/1997 Kimura et al. ..... 333/181
5,741,373 A * 4/1998 Suzuki et al. ..... 148/306
5,966,064 A * 10/1999 Yoshizawa et al. ..... 336/221
6,232,775 B1 * 5/2001 Naitoh et al. ..... 324/249
6,648,990 B1 * 11/2003 Yoshizawa ..... 148/313
6,828,046 B1 * 12/2004 Ikeda et al. ..... 428/812

FOREIGN PATENT DOCUMENTS

EP 1001437 A1 * 5/2000
JP 1-242755 9/1989
JP 9-20965 1/1997
JP 2000-119821 A * 4/2000

* cited by examiner

*Primary Examiner*—George Wyszomierski
(74) *Attorney, Agent, or Firm*—Sughrue Mion, PLLC

(57) ABSTRACT

A low core loss magnetic alloy with a high saturation magnetic flux density, which has a composition represented by the general formula:

$$(Fe_{1-a}Co_a)_{100-y-c}M'_yX'_c(\text{atomic }\%)$$

where M' represents at least one element selected from V, Ti, Zr, Nb, Mo, Hf, Ta, and W, X' represents Si and B, an Si content (atomic %) is smaller than a B content (atomic %), the B content is from 4 to 12 atomic %, and the Si content is from 0.01 to 5 atomic %, a, y, and c satisfy respectively $0.2<a<0.6$, $6.5\leqq y\leqq 15$, $2\leqq c\leqq 15$, and $7\leqq (y+c)\leqq 20$, at least a part of an alloy structure being occupied by crystal grains having grain size of not larger than 50 nm, a saturation magnetic flux density $B_s$ being not less than 1.65 T, and a core loss $P_{cm}$ per unit volume in conditions at 80° C., f=20 kHz, and $B_m$=0.2 T being not more than 15 W/kg.

18 Claims, 2 Drawing Sheets

LOW CORE LOSS MAGNETIC ALLOY WITH HIGH SATURATION MAGNETIC FLUX DENSITY AND MAGNETIC PARTS MADE OF SAME

FIELD OF THE INVENTION

The present invention relates to a low core loss magnetic alloy with a high saturation magnetic flux density showing particularly the low core losses and high performance magnetic parts made of the alloy, which are used for reactors for a large current, choke coils for an active filter, smoothing choke coils, various transformers, parts for a countermeasure of noise such as common mode choke coils and magnetic shields, power supplies for laser, pulse power magnetic parts for accelerators, motors, generators, and others.

BACKGROUND OF THE INVENTION

Silicon steels, ferrites, amorphous alloys, and Fe-base nano-crystalline alloy materials, or others are known as soft magnetic materials used for reactors for the large current, the choke coils for the active filter, the smoothing choke coils, the various transformers, the parts of the countermeasure of noise such as the magnetic shield material, power supplies for laser, the pulse power magnetic parts for the particle accelerator, or others. However, ferrite materials are generally low in a saturation magnetic flux density, poor in a temperature characteristic, and are not suitable for applications of high power in which a large operation magnetic flux density is needed, from a reason that the ferrites are liable to saturate magnetically. With regard to the silicon steels, they are large in the core losses with respect to the application at a high frequency, although they are not expensive, and have high in the saturation magnetic flux densities. In the case of Fe-base amorphous alloys, problems are posed that they have large magnetostriction and their characteristics are deteriorated resulting from stresses they undergo, and that they generate large noises in the applications such as a case where currents of an audible frequency band are superposed. On the other hand, in Co-base amorphous alloys, there are problems that its practical material has a low saturation magnetic flux density so as to have not more than 1 T (tesla), and is thermally unstable. Therefore, when the Co-base amorphous alloys are used for the application of high power, there cause problems that size of magnetic parts made of the alloy become large and that the core losses of them are increased because of aged deterioration.

Since Fe-base nano-crystalline alloys show excellent soft magnetic properties, it is used for magnetic cores of such as the common mode choke coils, high frequency transformers, pulse transformers, and others. As a representative composition, Fe—Cu—(Nb, Ti, Zr, Hf, Mo, W, Ta)—Si—B alloys, Fe—Cu—(Nb, Ti, Zr, Hf, Mo, W, Ta)—B alloys, or others disclosed in U.S. Pat. No. 4,881,989 or JP-A-01-242755 is known. These Fe-base nano-crystalline alloys are produced after amorphous alloys of them were formed by being rapidly quenched from generally their liquid phases or vapor phases, and then are finely crystallized by a heat treatment. As methods of quenching from the liquid phase, there are known a single roll method, a double roll method, a centrifugal quenching method, a rotating liquid spinning method, an atomization method, a cavitation method, and others. In addition, the methods of quenching from the vapor phase, there are known a sputtering method, a vapor deposition method, an ion plating method, and others are known.

The Fe-base nano-crystalline alloys are produced after the amorphous alloys of them were produced by the above mentioned methods, and then are finely crystallized into the products which hardly show thermal instability as viewed in the amorphous alloys, and are known to show the high saturation magnetic flux densities the same degrees as those of the Fe-base amorphous alloys, low magnetostriction, and the excellent soft magnetic properties. Furthermore, the nano-crystalline alloys are known to be small in the aged deterioration, and also to be excellent in the temperature characteristics.

Further, addition of Co to the Fe-base nano-crystalline alloy is also investigated, and JP-A-09-20965 discloses that a range of an excellent ratio of a Co amount is not more than 0.2.

Furthermore, as Co-base nano-crystalline alloys, alloys disclosed in U.S. Pat. No. 5,151,137 are known. However, it is difficult to realize the high saturation magnetic flux density and the low core loss in these alloys.

When compared with materials of a related art having substantially the same saturation magnetic flux density, an Fe-base nano-crystalline soft magnetic alloy is high in permeability, and are low in the core loss, thus is excellent in the soft magnetic property. However, in the Fe—Cu—Nb—Si—B alloy corresponding to a representative nano-crystalline soft magnetic alloy, it is difficult to realize the low core loss in a condition where the saturation magnetic flux density exceeds 1.65 T. Furthermore, even when Co is added, a remarkable increase of the saturation magnetic flux density cannot be confirmed.

On the other hand, in an Fe—Zr—B alloy or an Fe—Nb—B alloy, materials increasing the saturation magnetic flux densities to not less than 1.65 T become hard to form, and it is difficult to produce the materials in large amount. Furthermore, the materials have drawbacks that they are poor in the temperature characteristics because their core losses increase rapidly in association with the elevation in temperature. Although such drawbacks that the materials are poor in the temperature characteristics are dissolved and features of high saturation magnetic flux densities are included in them through the addition of Co, these alloys which are heat treated in a non-magnetic field have a problem that their core losses are remarkably large compared with Fe-base materials having no addition of Co. Therefore, these alloys are difficult to be used for the various magnetic parts described above. Furthermore, these alloys have a problem in terms of a short life of nozzle, because reactivity of the alloys with the nozzle is enhanced in the case of producing them in the large amount.

SUMMARY OF THE INVENTION

Accordingly, it is an object of the present invention to provide a magnetic alloy having a high saturation magnetic flux density and a low core loss, and capable of being further easily produced, and magnetic parts made of the alloy.

Thus, according to a first aspect of the invention there is provided with a low core loss magnetic alloy with a high saturation magnetic flux density, which has a composition represented by the general formula:

$$(Fe_{1-a}Co_a)_{100-y-c}M'_yX'_c(\text{atomic }\%)$$

where M' represents at least one element selected from V, Ti, Zr, Nb, Mo, Hf, Ta, and W, X' represents Si and B, an Si content (atomic %) is smaller than B content (atomic %), the B content is from 4 to 12 atomic %, and the Si content is from 0.01 to 5 atomic %, a, y, and c satisfy respectively $0.2<a<0.6$, $6.5\leqq y\leqq 15$, $2\leqq c\leqq 15$, and $7\leqq(y+c)\leqq 20$, at least a part of alloy structures are occupied by crystal grains having grain size of not larger than 50 nm, a saturation magnetic flux density $B_s$ is not less than 1.65 T, and a core loss $P_{cm}$ per unit volume in conditions at 80° C., f=20 kHz, and $B_m$=0.2 T is not more than 15 W/kg.

Further, according to a second aspect of the invention there is provided with a low core loss magnetic alloy with a high saturation magnetic flux density, which has a composition represented by the general formula:

$$(Fe_{1-a}Co_a)_{100-y-c}M'_yX'_c(\text{atomic }\%)$$

where not more than 5 atomic % in total of Fe and Co are substituted by at least one element selected from Cu and Au, M' represents at least one element selected from V, Ti, Zr, Nb, Mo, Hf, Ta, and W, X' represents Si and B, an Si content (atomic %) is smaller than B content (atomic %), the B content is from 4 to 12 atomic %, and the Si content is from 0.01 to 5 atomic %, a, y, and c satisfy respectively $0.2<a<0.6$, $6.5\leqq y\leqq 15$, $2\leqq c\leqq 15$, and $7\leqq(y+c)\leqq 20$, at least a part of alloy structures are occupied by crystal grains having grain size of not larger than 50 nm, a saturation magnetic flux density $B_s$ is not less than 1.65 T, and a core loss $P_{cm}$ per unit volume in conditions at 80° C., f=20 kHz, and $B_m$=0.2 T is not more than 15 W/kg.

DETAILED DESCRIPTION OF THE INVENTION

Figure 1:
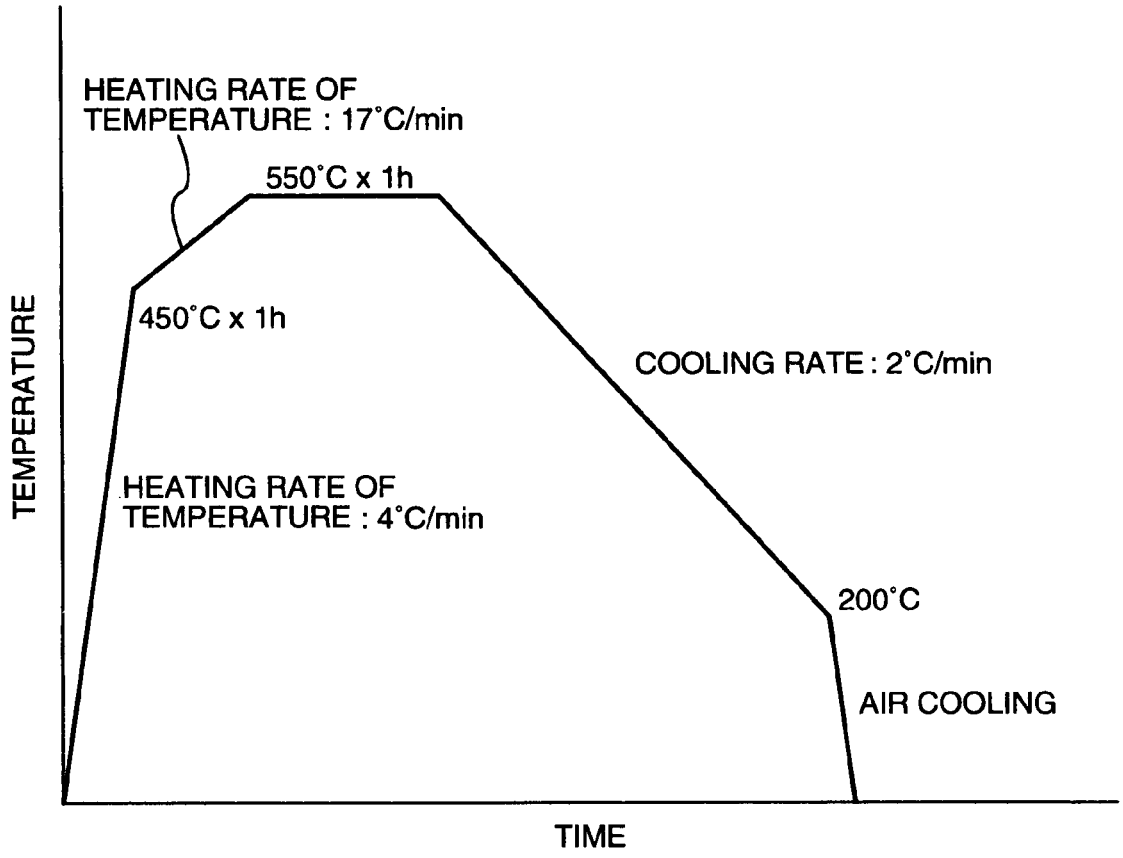
FIG. 1 is a view showing an example of a pattern of a heat treatment according to the invention.

After once producing an amorphous alloy by rapidly quenching a molten metal of the above composition through the use of a super quenching method such as a single roll method, or others, an alloy of the invention is produced by forming extremely fine crystal having an average grain size of not larger than 50 nm by processing thus produced amorphous alloy with working and thereafter by being subjected to heat treatment through elevating temperature at not lower than a crystallization temperature. The amorphous alloy before the heat treatment is desirable not to include a crystal phase. However, the crystal phase may be included in a part of the amorphous alloy. The super quenching method such as the single roll method, or others, is possible to be conducted in an atmospheric air in a case where active metals are not included in the elements. However, in the case where the active metals are included in the elements, the super quenching is conducted in an inert gas such as Ar, He, or others, or in an atmosphere of depressurization. Furthermore, there is a case where the super quenching is conducted in an atmosphere containing a nitrogen gas, a carbon mono oxide gas, or a carbon dioxide gas. The heat treatment is generally conducted in the inert gases such as an argon gas, a nitrogen gas, helium, or others, or in a vacuum. The heat treatment in a magnetic field is conducted at least a part of the period of heat treatment by applying the sufficient magnetic field for saturating the alloy with magnetic fluxes to impart induced magnetic anisotropy. Although the intensity of an applied magnetic field is dependent on a shape of an alloy core, it is not less than 8 $kAm^{-1}$ and applied generally in a width direction (in case of a wound core, in a direction of height of magnetic core) of a ribbon. The applied magnetic field may be any of a dc magnetic field, an ac magnetic field, or a repeated pulse magnetic field. The magnetic field is applied generally during a period of not shorter than 20 minutes in temperature at a range of not lower than 200° C. When the magnetic field is applied during elevating the temperature, keeping at a constant temperature, and even during cooling, a core loss becomes low and a squareness ratio becomes small, and a further preferable result can be obtained. When a squareness ratio Br/Bs is adjusted to not more than 10%, in particular, a low core loss is obtained and the preferable results in view of the application can be achieved. In contrast thereto, when the amorphous alloy is heat treated in a magnetic free field state and not applying a method of the heat treatment in the magnetic field, the core loss is remarkably deteriorated.

The heat treatment is desirable to be conducted in an inert gas atmosphere generally having a dew point at not higher than −30° C., when the heat treatment is conducted in the inert gas atmosphere having the dew point at not higher than −60° C., dispersion in the core losses are restrained to be small, and the preferable result will be obtained. The ultimate temperature at the time of the heat treatment is not lower than the crystallization temperature, and in general, in a range of 450° C. through 700° C. In the case of a heat treatment pattern for holding at the constant temperature, a holding time at the constant temperature is generally not longer than 24 hours from a view point of mass productivity, and is preferably not longer than 4 hours. An average elevating rate of temperature during the heat treatment is from 0.1 to 200° C./min, further preferably from 0.1 to 100° C./min, an average cooling rate is preferably from 0.1 to 3000° C./min, further preferably from 0.1 to 100° C./min, in these ranges, in particular, the alloys of low core losses can be obtained. The heat treatment can be conducted by not a single step but by multi-steps or a plurality of times of the heat treatment. Furthermore, the alloy can be subjected to heat treatment by making the alloy to generate heat by applying a direct current, an alternate current, or a pulse current to the alloy.

The alloy of the present invention produced through processes described above can easily realize characteristics such as the saturation magnetic flux density $B_s$ of not less than 1.65 T, and a core loss $P_{cm}$ per unit weight of not more than 15 W/kg in the conditions at 80° C., f=20 kHz, and $B_m$=0.2 T.

In the low core loss magnetic alloy with the high saturation magnetic flux density, a Co amount ratio a needs to correspond to $0.2<a<0.6$. Such a condition as that a is not more than 0.2 is not preferable since under the condition it is difficult to achieve the low core loss and the high saturation magnetic flux density of not less than 1.65 T. Such a alloy with the ratio a not less than 0.6 is not preferable since a reduction of the saturation magnetic flux density or a rapid increase of core loss will take place. A particularly preferable range of the Co amount ratios a is $0.3\leqq a\leqq 0.55$, and a further preferable range of the Co amount ratios a is $0.3\leqq a\leqq 0.5$. This range is practically preferable since in this range the low core loss alloy can be obtained, in particular, at a use temperature higher than a room temperature and with the saturation magnetic flux density not smaller than 1.7 T.

In the low core loss magnetic alloy with the high saturation magnetic flux density, M' and X' are the elements to expedite amorphous phase formation. M' represents at least one element selected from V, Ti, Zr, Nb, Mo, Hf, Ta, and W, an M' amount y is in the range of $5 \leqq y \leqq 15$, an X' amount c is in the range of $2 \leqq c \leqq 15$, and y and c satisfy $7 \leqq (y+c) \leqq 20$. Such a condition as that y is less than 5 atomic % is not preferable since a fine crystal grain alloy structure cannot be obtained after the heat treatment and the core loss increases remarkably. Such a condition as that y exceeds 15 atomic % is not preferable since there is a remarkable reduction of the saturation magnetic flux density or an increase of the core loss. X' represents Si and B. Such conditions as that (y+c) exceeds 20 atomic % is not preferable since the saturation magnetic flux density decreases, and that (y+c) is less than 7 atomic % is not preferable since the condition invites a remarkable increase of the core loss. It is necessary that the Si content(atomic %) is smaller than the B content (atomic %) This is because when the Si content exceeds the B content an effect of the increase of the saturation magnetic flux density in association with addition of Co becomes not remarkable, and it becomes difficult to obtain the characteristics of the high saturation magnetic flux density and the low core loss. Such conditions as that the X' amount c is less than 2 atomic % is not preferable since it is hardly realized to make the fine crystal grains after the heat treatment, and that c exceeds 15 atomic % is not preferable since the condition invites the reduction of the saturation magnetic flux density. In particular, when the B content is from 4 to 12 atomic %, the condition is preferable since the core loss is low. Further preferable is a case where the B content is from 4 to 10 atomic %. Further, in the case of the alloy containing not less than 0.01 atomic % Si, since a reaction of the alloy with a nozzle is restrained and formation of coarse crystals on a surface of the alloy can be restrained, preferable results such as easy production and the decrease of the core loss can be obtained. When the Si content is from 0.01 to 5 atomic %, particularly preferable results can be obtained since the effect of the increase of the saturation magnetic flux density in association with the addition of Co is large, reactivity of the alloy with the nozzle is improved, mass productivity is enhanced, and showing the high saturation magnetic flux density and low core loss characteristics.

Furthermore, an existence of the amorphous phase in a remaining portions of the crystal grains having the average grain size of not larger than 50 nm can obtain the further preferable results since a high resistivity can be realized, the crystal grains are made fine, and the core loss is reduced.

In the low core loss magnetic alloy with the high saturation magnetic flux density, the further preferable results can be obtained by carrying out processing such as by covering surfaces of alloy ribbons with powder or films of if necessary, $Si_2O$, MgO, $Al_2O_3$, and others, forming insulation layers on the surfaces thereof after a surface treatment through chemical conversion treatment, forming oxide insulation layers on the surfaces thereof through anode oxidation treatment, and conducting insulation between layers. This is because there is the effect to reduce an influence of eddy currents particularly in a high frequency travelling between layers and improving the core loss in the high frequency. This effect is particularly significant when the alloy is used for a magnetic core constituted from the ribbon of a excellent surface and a wide width. Furthermore, when producing the magnetic core from the alloy of the invention, if necessary, the core can be processed through impregnating, coating, or others. The alloys of the invention achieve their best performance when used for purposes of the high frequency, in particular, for application such that the pulse currents are passed through them, however, they can be used also for application such as a sensor and the magnetic parts for a low frequency. In particular, the alloys exhibit excellent characteristics for the application where magnetic saturation is key issues, and are particularly suited to the application for power electronics of high power.

The alloys of the invention which is subjected to the heat treatment while being applied the magnetic field in a direction perpendicular to a direction of magnetizing the core during actual operation can obtain the lower core loss than that of a material with the high saturation magnetic flux density of a related art. Furthermore, the alloys of the invention can achieve excellent characteristics even in states of the thin film or the powder.

In the low core loss magnetic alloy with the high saturation magnetic flux density, not more than 5 atomic % in total of Co and Fe may be substituted by at least one element selected from Cu and Au. The crystal grains are further made uniform and fine, and further reduces the core loss by substituting Cu or Au. A particularly preferable substituting amount is from 0.1 to 3 atomic %, the production of the alloys is easy in this range, in particular, the low core loss can be achieved.

In the low core loss magnetic alloy with the high saturation magnetic flux density, a part of Co may be substituted by Ni. Corrosion resistance is improved or induced magnetic anisotropy can be adjusted by substituting Ni.

In the low core loss magnetic alloy with the high saturation magnetic flux density, a part of M' may be substituted by at least one element selected from Cr, Mn, Sn, Zn, In, Ag, Sc, platinum group elements, Mg, Ca, Sr, Y, rare earth elements, N, O, and S. By Substituting at least one element selected from Cr, Mn, Sn, Zn, In, Ag, Sc, platinum group elements, Mg, Ca, Sr, Y, rare earth elements, N, O, and S for a part of M', effects such as the corrosive resistance is improved, the resistivity is enhanced, the magnetic properties are adjusted, and others are obtained.

Moreover, a part of X' may be substituted by at least one element selected from C, Ge, Ga, Al, and P. In the substitution at least one of element selected from C, Ge, Ga, Al, and P for a part of the X', there are effects such as the magnetostriction is adjusted, the crystal grain is made fine, and others.

In the low core loss magnetic alloy with the high saturation magnetic flux density, at least in a part of the alloy structure, the crystal grains having the average grain size not larger than 50 nm are formed. It is desirable that the crystal grains occupy at a rate of not less than 30% of the alloy structure, is further preferable that the crystal grains occupy at a rate of not less than 50% of the alloy structure, and is particularly preferable that the crystal grains occupy at a rate of not less than 60% of the alloy structure. The particularly desirable average crystal grain size is from 2 to 30 nm, and the particularly low core loss can be obtained in this range.

In the low core loss magnetic alloy with the high saturation magnetic flux density, the crystal grains formed in the alloy have the crystal phases of the body centered cubic structures (bcc) mainly composed of Fe and Co, and may dissolve Si, B, Al, Ge, Zr, and others. Furthermore, they may include ordered lattices. In the vicinity of a=0.5, the ordered lattices are easily formable. In the compositions in the vicinity of this, the core loss particularly reduces. Although the remaining portions other than the above-described crystal phases are mainly the amorphous phases, the alloys substantially occupied only by the crystal phases are also included in this invention. In the case of the alloys containing Cu or Au, there are cases where there also existing the crystal phases of face centered cubic structures (fcc phase) containing Cu or Au in a part of the alloy structure.

Further, in the case of existing the amorphous phases on the periphery of the crystal grains, the resistivity of the alloy is enhanced, the crystal grains thereof are made fine and the soft magnetic properties thereof are improved resulting from restraint of growths of the crystal grains, and, therefore, further preferable results can be obtained.

Furthermore, a part of the alloy may includes the compound phase, although the alloys show the further low core losses in the case of not existing compound phases in the alloys of the invention.

According to another aspect of the invention, there is provided with magnetic parts made of the low core loss magnetic alloy with the high saturation magnetic flux density. High performance or small sized magnetic parts suited to various reactors for a large current such as an anode reactor, choke coils for an active filter, smoothing choke coils, various transformers, parts of a countermeasure of noise such as magnetic shields and magnetic shield materials, power supplies for laser, pulse power magnetic parts for a particle accelerator can be realized by constituting the magnetic parts by means of the alloys of the invention.

DESCRIPTION OF THE PREFERRED EMBODIMENTS

Hereinafter, the present invention will be described according to the embodiments, the invention, however, is not restricted to these descriptions.

EXAMPLE 1

A molten alloy having a composition represented by the general formula:

$$(Fe_{1-a}Co_a)_{bal.}Cu_{0.7}Nb_{6.8}Si_{0.4}B_{9.2}(\text{atomic }\%)$$

was rapidly quenched by a single roll method to produce an amorphous alloy ribbon of 5 mm in width and 18 μm in thickness. Next, this amorphous alloy ribbon was wound into dimensions of 19 mm in outer diameter and 15 mm in inner diameter to produce a toroidal core.

Figure 2:
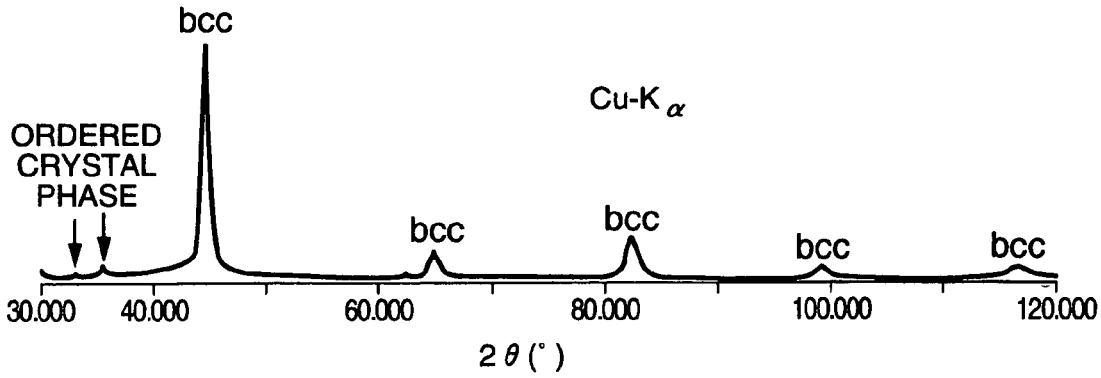
FIG. 2 is a view showing an example of a X-ray diffraction pattern for alloys according to the invention.

Thus produced magnetic core is inserted into a heat treatment furnace in a nitrogen gas atmosphere, and is subjected to a heat treatment with a pattern of the heat treatment shown in FIG. 1. During the heat treatment, a magnetic field of 280 $kAm^{-1}$ is applied in a direction perpendicular (width direction of alloy ribbon) to a magnetic path of an alloy core, that is, in a height direction of the core. An alloy after the heat treatment is crystallized, and as a result of an observation by an electron microscope it is found that most of the alloy structures were occupied by fine crystal grains of body centered cubic structures having grain size of degrees of from 10 to 20 nm, and thus a ratio of the crystal grains is estimated as the degree of 70%. Most of the crystal phases are the body centered cubic structures, and it was confirmed that ordered lattices existed in the compositions in the vicinity of a=0.5. Matrixes of remaining portions were mainly amorphous phases. An x-ray diffraction pattern of the alloy when a=0.5 is shown in FIG. 2. From the x-ray diffraction pattern of the alloy, peaks of the crystal showing the crystal phases of the body centered cubic structures were confirmed, and the peaks showing the existence of the ordered lattices were also confirmed.

Figure 3:
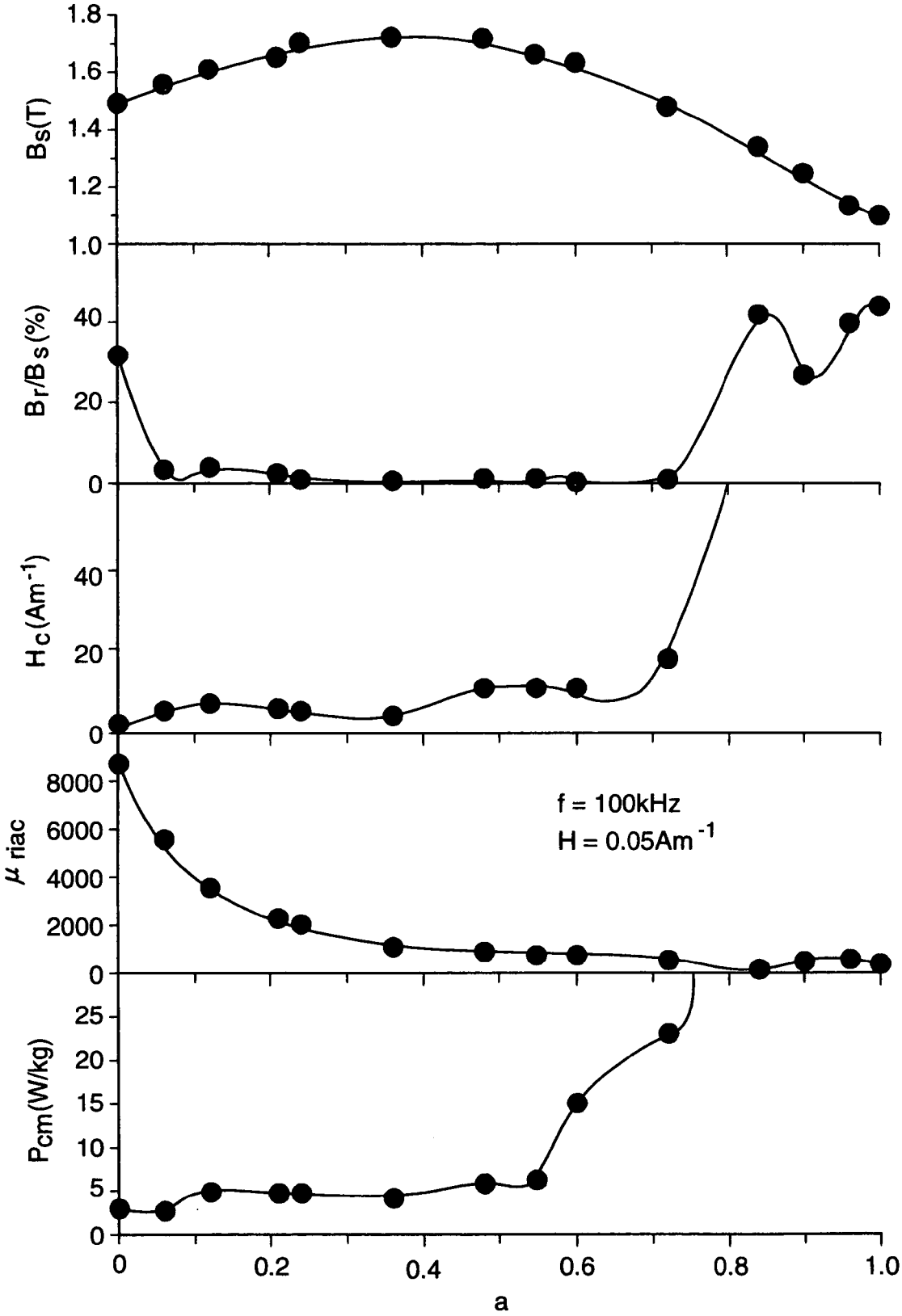
FIG. 3 is a view showing an example of Co amount dependency of a magnetic property for alloys according to the invention.

Next, the magnetic core of these alloys were measured with respect to a dc B—H loop, an ac relative initial permeability $\mu_{riac}$ at 100 kHz, and a core loss $P_{cm}$ per unit weight in conditions at 80° C., f=20 kHz and $B_m$=0.2 T. FIG. 3 shows saturation magnetic flux densities $B_s$, squareness ratios $B_r/B_s$, coercive force $H_c$, the ac relative initial permeabilities $\mu_{riac}$ at 100 kHz, and the core losses $P_{cm}$ per unit weight in conditions at 80° C., f=20 kHz, and $B_m$=0.2 T. The saturation magnetic flux densities $B_s$ show high values of not less than 1.65 T in the composition in which Co amount a is larger than 0.2 and smaller than 0.6, and the core losses $P_{cm}$ show low values of not more than 15 W/kg. Particularly high $B_s$ values are obtained in a range of $0.3 \leqq a \leqq 0.55$.

EXAMPLE 2

A molten alloy having compositions shown in table 1 was rapidly quenched by a single roll method in an Ar gas atmosphere to produce an amorphous alloy ribbon of 5 mm in width and 18 μm in thickness. This amorphous alloy ribbon was wound into dimensions of 19 mm in outer diameter and 15 mm in inner diameter to produce a toroidal core. This alloy core is subjected to a heat treatment with a pattern of the heat treatment similar to that in the example 1 to make measurement with respect to its magnetism. Within an alloy structure after the heat treatment, ultrafine crystal grains with grain size of not larger than 50 nm are formed in a parent amorphous phase. Main crystal phases are body centered cubic (bcc) phases containing mainly Fe and Co and when containing Cu or Au, although X-ray analyses of them is not clear and they are not listed in a table, it was confirmed as a result of electron beam diffraction by the use of an electron microscope that face centered cubic (fcc) phases with the grain size of not larger than 10 nm containing Cu or Au are also slightly formed. Table 1 shows saturation magnetic flux densities $B_s$, squareness ratios $B_r/B_s$, and core losses $P_{cm}$ per unit weight in conditions at 80° C., f=20 kHz, and $B_m$=0.2 T. For comparison, magnetic properties of alloys other than compositions in the invention are also shown. The alloys of the invention having the squareness ratios $B_r/B_s$ of not more than 10% show the low core losses $P_{cm}$ in particular. In contrast thereto, although Fe base alloys of other than the invention with the saturation magnetic flux densities of not less than 1.65 T have $P_{cm}$ larger than that of the alloys of the present invention, and are of the high saturation magnetic flux densities, core losses are large, therefore the alloys of the invention show excellent characteristics. Alloy materials other than the invention having low core losses $P_{cm}$ are low in the saturation magnetic flux density $B_s$, and cannot obtain $B_s$ exceeding 1.65 T.

TABLE 1

| | No. | Composition (atomic %) | $B_s$ (T) | $B_rB_s^{-1}$ (%) | Pcm (W/kg) | Formed crystal phase |
|---|---|---|---|---|---|---|
| Examples of the invention | 1 | $(Fe_{0.75}Co_{0.25})_{bal.}Cu_1Nb_7Si_1B_9Mn_{0.2}$ | 1.69 | 1 | 3.2 | bcc + AM |
| | 2 | $(Fe_{0.7}Co_{0.3})_{bal.}Cu_{0.8}Nb_{6.5}Si_{0.1}B_9Ni_{0.2}$ | 1.70 | 1 | 4.2 | bcc + AM |
| | 3 | $(Fe_{0.6}Co_{0.4})_{bal.}Cu_{0.9}Nb_{6.5}Si_{0.5}B_9$ | 1.72 | 1 | 4.6 | bcc + AM |
| | 4 | $(Fe_{0.45}Co_{0.55})_{bal.}Cu_{1.1}Zr_6Si_{0.3}B_9Al_{0.2}O_{0.001}$ | 1.70 | 2 | 7.5 | bcc + AM |
| | 5 | $(Fe_{0.49}Co_{0.51})_{bal.}Hf_{6.5}Si_{0.5}B_7Cr_{0.2}$ | 1.71 | 2 | 7.2 | bcc + AM |
| | 6 | $(Fe_{0.42}Co_{0.58})_{bal.}Cu_{0.5}Hf_5Si_1B_{10}Mn_{0.1}$ | 1.67 | 1 | 7.9 | bcc + AM |
| | 7 | $(Fe_{0.41}Co_{0.59})_{bal.}Cu_{0.7}Zr_6Mo_1Si_{0.5}B_{10}C_{0.2}$ | 1.65 | 1 | 14.6 | bcc + AM |
| | 8 | $(Fe_{0.79}Co_{0.21})_{bal.}Cu_{1.6}Hf_6V_{0.5}Si_1B_9P_{0.3}W_{0.1}$ | 1.65 | 1 | 2.9 | bcc + AM |
| | 9 | $(Fe_{0.78}Co_{0.22})_{bal.}Cu_1Nb_4Zr_3Si_{0.02}B_8$ | 1.66 | 2 | 3.0 | bcc + AM |
| | 10 | $(Fe_{0.79}Co_{0.21})_{bal.}Cu_{0.7}Zr_{6.5}Si_1B_{11}Ti_{0.5}N_{0.01}$ | 1.65 | 1 | 2.9 | bcc + AM |
| | 11 | $(Fe_{0.55}Co_{0.45})_{bal.}Cu_{0.8}Zr_8Si_{0.3}B_6Sn_{0.02}$ | 1.73 | 1 | 7.4 | bcc + AM |
| | 12 | $(Fe_{0.50}Co_{0.50})_{bal.}Cu_{0.2}Nb_7Si_1B_9Zn_{0.02}S_{0.01}$ | 1.71 | 1 | 7.3 | bcc + AM |
| | 13 | $(Fe_{0.60}Co_{0.40})_{bal.}Cu_{0.4}Nb_{6.8}Si_{0.1}B_9Ni_{0.5}Ag_{0.1}$ | 1.72 | 1 | 7.6 | bcc + AM |
| | 14 | $(Fe_{0.61}Co_{0.39})_{bal.}Nb_{6.5}Si_{0.01}B_9In_{0.1}Sm_{0.01}$ | 1.75 | 5 | 8.4 | bcc + AM |
| | 15 | $(Fe_{0.65}Co_{0.35})_{bal.}Cu_{0.1}Nb_{6.5}Si_{0.1}B_{11}Ni_{0.5}Pd_{0.2}$ | 1.75 | 1 | 8.2 | bcc + AM |
| | 16 | $(Fe_{0.65}Co_{0.35})_{bal.}Au_{0.1}Nb_{6.6}Si_1B_{10}Pt_{0.1}Mg_{0.01}$ | 1.73 | 3 | 8.2 | bcc + AM |
| | 17 | $(Fe_{0.67}Co_{0.33})_{bal.}Au_{0.2}Nb_7Si_{0.2}B_{8.5}Ga_{0.1}$ | 1.72 | 2 | 8.1 | bcc + AM |
| | 18 | $(Fe_{0.75}Co_{0.25})_{bal.}Nb_{6.5}Si_1B_9Cr_{0.2}Ru_{0.2}$ | 1.72 | 8 | 8.8 | bcc + AM |
| | 19 | $(Fe_{0.69}Co_{0.21})_{bal.}Hf_6Si_{0.01}B_{10}Al_{0.2}$ | 1.65 | 10 | 7.8 | bcc + AM |
| | 20 | $(Fe_{0.69}Co_{0.31})_{bal.}Zr_{6.5}Si_{0.2}B_{8.5}V_{0.2}$ | 1.70 | 9 | 8.9 | bcc + AM |
| | 21 | $(Fe_{0.69}Co_{0.31})_{bal.}Zr_7Si_{0.01}B_6$ | 1.74 | 5 | 8.5 | bcc + AM |
| | 22 | $(Fe_{0.68}Co_{0.32})_{bal.}Hf_7Si_{0.01}B_7$ | 1.72 | 7 | 9.7 | bcc + AM |
| | 23 | $(Fe_{0.78}Co_{0.22})_{bal.}Ta_7Si_{0.01}B_{10}$ | 1.66 | 10 | 8.8 | bcc + AM |
| | 24 | $(Fe_{0.67}Co_{0.33})_{bal.}Nb_7Si_{0.01}B_{10}$ | 1.70 | 8 | 8.7 | bcc + AM |
| | 25 | $(Fe_{0.70}Co_{0.30})_{bal.}Nb_{6.8}Si_{0.4}B_{9.5}$ | 1.72 | 7 | 9.3 | bcc + AM |
| | 26 | $(Fe_{0.71}Co_{0.29})_{bal.}Zr_7Si_{0.01}B_6Ti_{0.02}$ | 1.76 | 8 | 9.8 | bcc + AM |
| | 27 | $(Fe_{0.60}Co_{0.40})_{bal.}Nb_7Si_{0.1}B_9Ni_{0.1}W_{0.02}$ | 1.71 | 8 | 10.2 | bcc + AM |
| | 28 | $(Fe_{0.59}Co_{0.41})_{bal.}Nb_7Si_{0.05}B_9S_{0.01}$ | 1.72 | 9 | 9.8 | bcc + AM |
| | 29 | $(Fe_{0.58}Co_{0.42})_{bal.}Nb_7Si_{0.02}B_{8.5}Pt_{0.0}$ | 1.74 | 8 | 10.1 | bcc + AM |
| | 30 | $(Fe_{0.49}Co_{0.51})_{bal.}Zr_7Si_{0.05}B_7Sc_{0.1}$ | 1.70 | 9 | 10.3 | bcc + AM |
| | 31 | $(Fe_{0.48}Co_{0.52})_{bal.}Nb_7Si_{0.1}B_9Ni_{0.1}Pd_{0.1}$ | 1.71 | 9 | 11.8 | bcc + AM |
| | 32 | $(Fe_{0.51}Co_{0.49})_{bal.}Cu_{0.1}Nb_6Si_{0.2}B_{10}Ge_{0.2}$ | 1.70 | 8 | 8.9 | bcc + AM |
| | 33 | $(Fe_{0.54}Co_{0.56})_{bal.}Cu_{0.2}Nb_5Si_{0.2}B_{10.5}P_{0.5}$ | 1.65 | 9 | 12.5 | bcc + AM |
| Referential examples | 34 | $Fe_{bal.}Cu_1Nb_3Si_{13.5}B_9$ | 1.24 | 7 | 2.1 | bcc + AM |
| | 35 | $(Fe_{0.8}Co_{0.2})_{bal.}Cu_{0.6}Nb_{2.6}Si_9B_9$ | 1.52 | 1 | 4.7 | bcc + AM |
| | 36 | $(Fe_{0.5}Co_{0.5})_{bal.}Cu_{0.8}Nb_3Si_9B_9$ | 1.54 | 1 | 6.8 | bcc + AM |
| | 37 | $Fe_{bal.}Zr_2Nb_4B_{8.5}$ | 1.64 | 56 | 18.1 | bcc + AM |
| | 38 | $Fe_{bal.}Au_{0.7}Nb_{2.5}Mo_{0.5}Si_{16}B_8$ | 1.20 | 15 | 3.8 | bcc + AM |
| | 39 | $Fe_{bal.}Cu_{1.1}Nb_3Si_{15.5}B_{6.5}$ | 1.23 | 8 | 2.2 | bcc + AM |
| | 40 | $Fe_{bal.}Zr_7B_2$ | 1.70 | 46 | 36.3 | bcc + AM |
| | 41 | $Fe_{bal.}Hf_7B_2$ | 1.60 | 48 | 33.4 | bcc + AM |
| | 42 | $Fe_{bal.}Nb_7B_9$ | 1.52 | 53 | 24.8 | bcc + AM |
| | 43 | $Fe_{bal.}Cu_1Nb_2Si_{11}B_9$ | 1.45 | 56 | 3.8 | bcc + AM |

bcc: Body centered cubic crystal
AM: Amorphous phase

EXAMPLE 3

A molten alloy 150 g having a composition shown in a table 2 was rapidly quenched by a single roll method in an Ar gas atmosphere to produce an amorphous alloy ribbon of 5 mm in width and 18 μm in thickness. As nozzles, quartz nozzles are used. The amorphous alloy ribbons are repeatedly produced by using the used nozzle, and the number of usable times of the nozzle until production of the ribbons having specified widths becomes difficult are studied. Obtained results are shown in the table 2. Furthermore, this amorphous alloy ribbon is wound into dimensions of 19 mm in outer diameter and 15 mm in inner diameter to produce a toroidal core. This alloy core is subjected to a heat treatment with a pattern of the heat treatment similar to that in the example 1 to make measurement with respect to its magnetism. Within an alloy structure after the heat treatment, ultrafine crystal grains with grain size of not larger than 50 nm are formed. Main crystal phases are body centered cubic (bcc) phases containing mainly Fe and Co and when containing Cu or Au, although X-ray analyses of them is not clear and they are not listed in a table, it was confirmed as a result of electron beam diffraction by the use of an electron microscope that face centered cubic (fcc) phases with grain size not larger than 10 nm containing Cu or Au are also slightly formed. The table 2 shows saturation magnetic flux densities $B_s$, squareness ratios $B_r/B_s$, and core losses $P_{cm}$ per unit weight in conditions at 80° C., f=20 kHz, and $B_m$=0.2 T. When Si amount is not less than 0.01 atomic %, the number of the usable times of the nozzle increase, and it is preferable in terms of mass productivity, however, when the Si amount becomes not less than a B amount, it is not preferable because $B_s$ decreases remarkably. A range of the Si amount preferable in particular is from 0.01 to 5 atomic %. In this range, a life of the nozzle is extended and a high $B_s$ value is maintained, therefore, a particularly preferable result can be obtained.

TABLE 2

| | No. | Composition (atomic %) | $B_s$ (T) | $B_rB_s^{-1}$ (%) | Pcm (W/kg) | a number of usable times N | Formed crystal phase |
|---|---|---|---|---|---|---|---|
| Examples of the invention | 44 | $(Fe_{0.61}Co_{0.39})_{bal.}Cu_{0.8}Nb_7Si_{0.1}B_9$ | 1.72 | 1 | 4.4 | 3 | bcc + AM |
| | 45 | $(Fe_{0.61}Co_{0.39})_{bal.}Cu_{0.8}Nb_7Si_{0.2}B_9$ | 1.71 | 1 | 4.2 | 4 | bcc + AM |
| | 46 | $(Fe_{0.61}Co_{0.39})_{bal.}Cu_{0.8}Nb_7Si_{0.5}B_9$ | 1.70 | 1 | 4.0 | 5 | bcc + AM |
| | 47 | $(Fe_{0.61}Co_{0.39})_{bal.}Cu_{0.8}Nb_7Si_1B_9$ | 1.68 | 1 | 3.8 | 6 | bcc + AM |
| | 48 | $(Fe_{0.65}Co_{0.35})_{bal.}Nb_7Si_2B_7$ | 1.67 | 4 | 9.8 | 6 | bcc + AM |
| | 49 | $(Fe_{0.65}Co_{0.35})_{bal.}Nb_7Si_3B_7$ | 1.65 | 4 | 9.7 | 6 | bcc + AM |
| | 50 | $(Fe_{0.65}Co_{0.35})_{bal.}Nb_{6.5}Si_4B_7$ | 1.65 | 5 | 10.6 | 6 | bcc + AM |
| | 51 | $(Fe_{0.66}Co_{0.34})_{bal.}Nb_7Si_{0.01}B_9$ | 1.75 | 6 | 9.7 | 3 | bcc + AM |
| | 52 | $(Fe_{0.66}Co_{0.34})_{bal.}Nb_{7.1}Si_{0.05}B_9$ | 1.74 | 6 | 9.6 | 3 | bcc + AM |
| | 53 | $(Fe_{0.67}Co_{0.33})_{bal.}Au_{0.3}Nb_{6.8}Si_5B_8$ | 1.66 | 7 | 9.8 | 5 | bcc + AM |
| | 54 | $(Fe_{0.68}Co_{0.32})_{bal.}Ta_{5.3}Si_{4.5}B_7$ | 1.68 | 9 | 10.8 | 6 | bcc + AM |
| | 55 | $(Fe_{0.69}Co_{0.31})_{bal.}Ta_{5.2}Si_{4.3}B_8$ | 1.65 | 9 | 11.5 | 5 | bcc + AM |
| | 56 | $(Fe_{0.69}Co_{0.31})_{bal.}Ta_{5.8}Si_{4.1}B_{8.1}$ | 1.65 | 10 | 11.9 | 5 | bcc + AM |
| Referential examples | 57 | $(Fe_{0.61}Co_{0.39})_{bal.}Cu_{0.8}Nb_7Si_{0.005}B_9$ | 1.72 | 1 | 4.6 | 1 | bcc + AM |
| | 58 | $(Fe_{0.82}Co_{0.18})_{bal.}Nb_7B_9$ | 1.64 | 14 | 16.1 | 1 | bcc + AM |
| | 59 | $(Fe_{0.67}Co_{0.33})_{bal.}Cu_{0.7}Nb_{2.7}Si_{9.5}B_9$ | 1.56 | 2 | 6.1 | 5 | bcc + AM |
| | 60 | $Fe_{bal.}Zr_7B_6$ | 1.65 | 9 | 15.9 | 1 | bcc + AM |
| | 61 | $Fe_{bal.}Cu_1Nb_3Si_{14}B_9$ | 1.20 | 4 | 2.8 | 7 | bcc + AM |
| | 62 | $Fe_{bal.}Cu_{1.2}Nb_7B_{9.5}$ | 1.52 | 8 | 5.8 | 1 | bcc + AM |

bcc: Body centered cubic crystal
AM: Amorphous phase

EXAMPLE 4

A molten alloy having a composition represented by the general formula:

$$(Fe_{0.7}Co_{0.3})_{bal.}Cu_{1.2}Nb_{6.8}Si_{1.1}B_{9.1}\text{(atomic \%)}$$

was rapidly quenched by a single roll method to produce an amorphous alloy ribbon of 20 mm in width and 20 μm in thickness. The amorphous alloy ribbon was then wound to produce a toroidal core.

Thus produced magnetic core was inserted into a heat treatment furnace in a nitrogen gas atmosphere, and was subjected to a heat treatment with a pattern of the heat treatment shown in FIG. 1. During the heat treatment, a magnetic field of 280 $kAm^{-1}$ was applied in a direction perpendicular (width direction of alloy ribbon) to a magnetic path of the alloy core, that is, in a height direction of the core. The alloy after the heat treatment is crystallized, thus as a result of an observation by an electron microscope, most of the alloy structures are found to be occupied by fine crystal grains of body centered cubic structures having grain size of degrees of from 10 to 20 nm, and a ratio of crystal grains is estimated as a degree of 70%. Most of crystal phases are the body centered cubic structures. Matrixes of remaining portions are mainly amorphous phases. A saturation magnetic flux density $B_s$ was 1.70 T, and a core loss $P_{cm}$ per unit weight in conditions at 80° C., f=20 kHz, and $B_m$=0.2 T was 4.2 W/kg. A transformer for an inverter which was produced using this magnetic core, was used for a power transformer of an inverter power source operating at 20 kHz, and an elevation in temperature ΔT of the transformer was measured. Results obtained are shown in a table 3. For comparison, the results of the transformer using a nano-crystalline FeZrB alloy having the saturation magnetic flux density 1.7 T of a related art are shown. The elevation in temperature ΔT of the transformer using the alloys of the invention is smaller and more excellent than the transformer using the nano-crystalline alloy showing the same 1.7 T for the $B_s$ the related art.

TABLE 3

| Alloy (atomic %) | ΔT (° C.) |
|---|---|
| $(Fe_{0.7}Co_{0.3})_{bal.}Cu_{1.2}Nb_{6.8}Si_{0.9}B_{9.1}$ (Example of the invention) | 36 |
| $Fe_{bal.}Zr_7B_{2.2}$ (Referential example) | 40 |

EXAMPLE 5

A molten alloy having a composition represented by the general formula:

$$(Fe_{0.6}Co_{0.4})_{bal.}Cu_{1.1}Nb_{6.8}Si_{0.5}B_{9.2}\text{(atomic \%)}$$

was rapidly quenched by a single roll method to produce an amorphous alloy ribbon of 20 mm in width and 20 μm in thickness. The amorphous alloy ribbon was then wound into dimensions of 35 mm in outer diameter and 25 mm in inner diameter to produce a toroidal core.

Thus produced magnetic core was inserted into a heat treatment furnace in a nitrogen gas atmosphere, and is subjected to a heat treatment with a pattern of the heat treatment shown in FIG. 1. During the heat treatment, a magnetic field of 280 $kAm^{-1}$ is applied in a direction perpendicular (width direction of alloy ribbon) to a magnetic path of the alloy core, that is, in a height direction of the core. The alloy after the heat treatment is crystallized, thus as a result of an observation by an electron microscope, most of alloy structures are found to be occupied by fine crystal grains of body centered cubic structures having grain size of a degree of 8 nm, and a ratio of the crystal grains is estimated as the degree of 68%. Most of crystal phases have the body centered cubic structures. Matrixes of remaining portions are mainly amorphous phases. A saturation magnetic flux density $B_s$ was 1.70 T, and a core loss $P_{cm}$ per unit weight in conditions at 80° C., f=20 kHz, and $B_m$=0.2 T was 4.5 W/kg. A choke coil for a switching power source was produced by forming gaps in the core. The core was used for a smoothing choke coil of a switching power source operating at 20 kHz.

An elevation in temperature is shown in a table 4. For comparison, a characteristic of a choke coil using a nanocrystalline FeZrB alloy of a related art having 1.7 T as $B_s$ is shown. When compared the choke coils having the same size with each other, the choke coil of the invention was small in the elevation of temperature ΔT and excellent in a quality.

TABLE 4

| Alloy (atomic %) | ΔT (° C.) |
|---|---|
| $(Fe_{0.6}Co_{0.4})_{bal.}Cu_{1.1}Nb_{6.8}Si_{0.5}B_{9.2}$ (Example of the invention) | 38 |
| $Fe_{bal.}Zr_7B_{2.2}$ (Referential example) | 42 |

INDUSTRIAL APPLICABILITY

According to the present invention, a low core loss magnetic alloy with a high saturation magnetic flux density showing in particular the low core loss having the high saturation magnetic flux density can be realized which is used for various reactors for a large current, choke coils for an active filter, smoothing choke coils, various transformers, parts for a countermeasure of noises such as magnetic shield materials, power supplies for laser, pulse power magnetic parts for accelerators, motors, generators, and others, and high performance magnetic parts using the alloy can also be realized, therefore effects thereof are remarkable.

What is claimed is:

1. A low core loss magnetic alloy with a high saturation magnetic flux density, which has a composition represented by the general formula:

$$(Fe_{1-a}Co_a)_{100-y-c}M'_yX'_c(\text{atomic }\%)$$

where M' represents at least one element selected from the group consisting of V, Ti, Zr, Nb, Mo, Hf, Ta, and W, X' represents Si and B, an Si content (atomic %) is smaller than a B content (atomic %), the B content is from 4 to 12 atomic %, and the Si content is from 0.01 to 5 atomic %, a, y, and c satisfy respectively $0.2<a<0.6$, $6.5\leqq y\leqq 15$, $2\leqq c\leqq 15$, and $7\leqq (y+c)\leqq 20$, at least a part of an alloy structure being occupied by crystal grains having grain size of not larger than 50 nm, a saturation magnetic flux density Bs being not less than 1.65 T, and a core loss $P_{cm}$ per unit volume in conditions at 80° C., f=20 kHz, and $B_m$=0.2 T being not more than 15 W/kg.

2. A low core loss magnetic alloy with a high saturation magnetic flux density as set forth in claim 1, wherein (a) satisfies $0.3\leqq a\leqq 0.55$.

3. A low core loss magnetic alloy with a high saturation magnetic flux density as set forth in claim 1, wherein a part of M' are substituted by at least one element selected from the group consisting of Cr, Mn, Sn, Zn, In, Ag, Sc, platinum group elements, Mg, Ca, Sr, Y, rare earth elements, N, O, and S.

4. A low core loss magnetic alloy with a high saturation magnetic flux density as set forth in claim 1, wherein a part of X' are substituted by at least one element selected from the group consisting of C, Ge, Ga, Al, and P.

5. A low core loss magnetic alloy with a high saturation magnetic flux density as set forth in claim 1, wherein the alloys have been subjected to a heat treatment in a magnetic field, and have a squareness ratio Br/Bs of not more than 10%.

6. A low core loss magnetic alloy with a high saturation magnetic flux density as set forth in claim 1, wherein a part of an alloy structure comprises amorphous phases.

7. A low core loss magnetic alloy with a high saturation magnetic flux density as set forth in claim 1, wherein at least a part of the crystal grains having grain size of not larger than 50 nm have a body centered cubic structure.

8. A low core loss magnetic alloy with a high saturation magnetic flux density as set forth in claim 1, wherein ordered lattices exist in the alloy structure.

9. Magnetic parts being constituted by the low core loss magnetic alloy with the high saturation magnetic flux density as set forth in claim 1.

10. A low core loss magnetic alloy with a high saturation magnetic flux density, which has a composition represented by the general formula:

$$(Fe_{1-a}Co_a)_{100-y-c}M'_yX'_c(\text{atomic }\%)$$

where not more than 5 atomic % in total of Fe and Co are substituted by at least one element selected from the group consisting of Cu and Au, M' represents at least one element selected from the group consisting of V, Ti, Zr, Nb, Mo, Hf, Ta, and W, X' represents Si and B, an Si content (atomic %) is smaller than B content (atomic %), the B content is from 4 to 12 atomic %, and the Si content is from 0.01 to 5 atomic %, a, y, and c satisfy respectively $0.2<a<0.6$, $6.5\leqq y\leqq 15$, $2\leqq c\leqq 15$, and $7\leqq (y+c)\leqq 20$, at least a part of alloy structure being occupied by crystal grains having grain size of not larger than 50 nm, a saturation magnetic flux density Bs being not less than 1.65 T, and a core loss $P_{cm}$ per unit volume in conditions at 80° C., f=20 kHz, and $B_m$=0.2 T being not more than 15 W/kg.

11. A low core loss magnetic alloy with a high saturation magnetic flux density as set forth in claim 10, wherein (a) satisfies $0.3\leqq a\leqq 0.55$.

12. A low core loss magnetic alloy with a high saturation magnetic flux density as set forth in claim 10, wherein a part of M' are substituted by at least one element selected from the group consisting of Cr, Mn, Sn, Zn, In, Ag, Sc, platinum group elements, Mg, Ca, Sr, Y, rare earth elements, N, O, and S.

13. A low core loss magnetic alloy with a high saturation magnetic flux density as set forth in claim 10, wherein a part of X' are substituted by at least one element selected from the group consisting of C, Ge, Ga, Al, and P.

14. A low core loss magnetic alloy with a high saturation magnetic flux density as set forth in claim 10, wherein the alloys have been subjected to a heat treatment in a magnetic field, and have a squareness ratio Br/Bs of not more than 10%.

15. A low core loss magnetic alloy with a high saturation magnetic flux density as set forth in claim 10, wherein a part of an alloy structure comprises amorphous phases.

16. A low core loss magnetic alloy with a high saturation magnetic flux density as set forth in claim 10, wherein at least a part of the crystal grains having grain size of not larger than 50 nm have a body centered cubic structure.

17. A low core loss magnetic alloy with a high saturation magnetic flux density as set forth in claim 10, wherein ordered lattices exist in the alloy structure.

18. Magnetic parts being constituted by the low core loss magnetic alloy with the high saturation magnetic flux density as set forth in claim 10.

* * * * *